US007649431B2

(12) United States Patent
Cho et al.

(10) Patent No.: US 7,649,431 B2
(45) Date of Patent: Jan. 19, 2010

(54) BAND PASS FILTER

(75) Inventors: Yun Hee Cho, Gyunggi-do (KR); Yun Hwi Park, Gyunggi-do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 0 days.

(21) Appl. No.: 11/905,786

(22) Filed: Oct. 4, 2007

(65) Prior Publication Data

US 2008/0100401 A1 May 1, 2008

(30) Foreign Application Priority Data

Oct. 27, 2006 (KR) ..... 10-2006-0105227
Oct. 27, 2006 (KR) ..... 10-2006-0105228

(51) Int. Cl.
*H03H 7/00* (2006.01)
*H01P 7/00* (2006.01)

(52) U.S. Cl. ..... 333/185; 333/175; 333/181

(58) Field of Classification Search ..... 333/175, 333/181, 184, 185, 204, 219
See application file for complete search history.

(56) References Cited

U.S. PATENT DOCUMENTS 6,504,456 B2 * 1/2003 Iio et al. ..... 333/202
7,012,484 B2 * 3/2006 Chang et al. ..... 333/175
7,397,331 B2 * 7/2008 Koizumi et al. ..... 333/219
7,443,268 B2 * 10/2008 Tsai et al. ..... 333/175

(Continued)

FOREIGN PATENT DOCUMENTS

JP 2-106701 8/1990

(Continued)

OTHER PUBLICATIONS

Japanese Office Action, with English Translation, issued in Japanese Patent Application No. JP 2007-272542 dated on Nov. 4, 2008.

(Continued)

*Primary Examiner*—Robert Pascal
*Assistant Examiner*—Kimberly E Glenn
(74) *Attorney, Agent, or Firm*—McDermott Will & Emery LLP

(57) ABSTRACT

There is provided a multi-layered band pass filter capable of improving a stop characteristic out of a pass band and reducing the entire size of the filter. The multi-layered band pass filter includes a ceramic laminated body having at least first to fifth dielectric layers laminated sequentially therein; first and second resonators having symmetrical patterns of first and second inductors formed on the first dielectric layer, and symmetrical patterns of first and second capacitors formed on the second dielectric layer so that they are at least partially overlapped with the patterns of the first and second inductors; a pattern of first and second load capacitors electrically capacitively coupled respectively to ends of the first and second resonators formed on the third dielectric layer; a pattern of first and second notching capacitors electrically capacitively coupled respectively to the other ends of the first and second resonators formed on the third dielectric layer; and first and second ground planes formed respectively on the fourth and fifth dielectric layers, wherein each of the patterns of the first and second inductors is composed of a low impedance portion formed of wide-width lines and a high impedance portion formed of meander-type narrow-width lines from the low impedance portion.

7 Claims, 12 Drawing Sheets

U.S. PATENT DOCUMENTS

| | | | |
|---|---|---|---|
| 2001/0030588 | A1 | 10/2001 | Son et al. |
| 2006/0192637 | A1 | 8/2006 | Urano et al. |

FOREIGN PATENT DOCUMENTS

| | | |
|---|---|---|
| JP | 05-199005 | 8/1993 |
| JP | 07-263911 | 10/1995 |
| JP | 09-069701 | 3/1997 |
| JP | 2001-320203 | 11/2001 |
| JP | 2004-266696 | 9/2004 |
| JP | 2005-151165 | 6/2005 |
| JP | 2006-101556 | 4/2006 |
| KR | 2002-0085977 | 11/2002 |
| KR | 10-2004-0092692 | 11/2004 |

OTHER PUBLICATIONS

Japanese Office Action issued in Japanese Patent Application No. JP 2007-272542 dated May 19, 2009.

* cited by examiner

BAND PASS FILTER

CROSS-REFERENCE TO RELATED APPLICATIONS

This application claims the priority of Korean Patent Application Nos. 2006-0105227 and 2006-0105228, filed on Oct. 27, 2006, in the Korean Intellectual Property Office, the disclosures of which are incorporated herein by reference.

BACKGROUND OF THE INVENTION

1. Field of the Invention

The present invention relates to a multi-layered band pass filter, and more particularly, to a multi-layered band pass filter capable of improving a stop characteristic out of a pass band and reducing the entire size of communication systems.

2. Description of the Related Art

In general, a band pass filter, which is a radio frequency (RF) device that is composed of input/output terminals that play a role in the input/output of a frequency signal; and a combination of a plurality of electrode patterns and a plurality of resonators having frequency selectivity, functions to pass only a frequency signal within a pass band out of frequency signals used for mobile telecommunication systems.

There has been an increasing demand for techniques of densely installing parts inside a substrate due to the increased request of small and thin wireless communication equipment such as portable phones. For this purpose, there has been proposed a method of forming a certain pattern on a multi-layered substrate, the pattern adjusting the coupling to the resonators using transmission lines such as strip lines.

FIG. 1 is a diagram illustrating a configuration of a conventional multi-layered band pass filter. As shown in FIG. 1, a body of the multi-layered band pass filter is manufactured by laminating a plurality of dielectric layers 1-5 formed of ceramic dielectric materials. Here, a first ground plane 6 and a second ground plane 13 are formed respectively on a first dielectric layer 1 and a fifth dielectric layer 5; an electrode pattern 11 coupled in parallel to resonators to form a coupling capacitor $C_C$ and electrode patterns 12*a* and 12*b* formed between the resonators and a grounding conductor to form a load capacitor $C_L$ are printed as a thick film on the second dielectric layer 2; first and second strip line resonators 10*a* and 10*b* are printed as a thick film on the third dielectric layer 3; and electrode patterns 8*a* and 8*b* formed between the resonators and the input/output terminals to form an input/output coupling capacitor $C_{01}$ and electrode patterns 9*a* and 9*b* formed between the resonators and a grounding conductor to form a load capacitor $C_L$ are printed on the fourth dielectric layer 4.

However, the resonators used in the conventional multi-layered band pass filter have a problem that the total volume of the filter is increased as their frequencies become low because the resonators are in the straight-line form having a constant width and their entire $\lambda/4$ length is used.

Also, since the input/output terminals have the same shape as the capacitor and are coupled to the resonators, an insertion loss of the filter is high in the multi-layered structure due to the change in process, for example the dimensional difference between an upper layer and a lower layer or the positional changes, which leads to the deteriorated performance of wireless telecommunication systems.

SUMMARY OF THE INVENTION

An aspect of the present invention provides a multi-layered band pass filter capable of improving a stop characteristic out of a pass band by maintaining a constant ratio of a high impedance portion and a low impedance portion using a step-impedance resonator, and reducing the entire size of the filter by forming the high impedance portion coupled to a grounding conductor in a meandered form.

An aspect of the present invention also provides a multi-layered band pass filter capable of improving an attenuation characteristic by directly coupling input/output units to a resonator with a tap shape to adjust a position of a tap in the resonator.

An aspect of the present invention also provides a multi-layered band pass filter capable of improving a stop characteristic for additional components in a lower band by coupling a notching capacitor to a tip of the high impedance portion of the resonator.

According to an aspect of the present invention, there is provided a multi-layered band pass filter including a ceramic laminated body having at least first to fifth dielectric layers laminated sequentially therein; first and second resonators having symmetrical patterns of first and second inductors formed on the first dielectric layer, and symmetrical patterns of first and second capacitors formed on the second dielectric layer so that they can be at least partially overlapped with the patterns of the first and second inductors; patterns of first and second load capacitors electrically capacitively coupled respectively to the first and second resonators formed on the third dielectric layer; and first and second ground planes formed respectively on the fourth and fifth dielectric layers, wherein each of the patterns of the first and second inductors is composed of a low impedance portion formed of wide-width lines and a high impedance portion grounded to the second ground plane and formed of meander-type narrow-width lines from the low impedance portion.

According to another aspect of the present invention, there is provided a multi-layered band pass filter including a ceramic laminated body having at least first to fifth dielectric layers laminated sequentially therein; first and second resonators having symmetrical patterns of first and second inductors formed on the first dielectric layer, and symmetrical patterns of first and second capacitors formed on the second dielectric layer so that they can be at least partially overlapped with the patterns of the first and second inductors; patterns of first and second load capacitors electrically capacitively coupled respectively to ends of the first and second resonators formed on the third dielectric layer; patterns of first and second notching capacitors electrically capacitively coupled respectively to the other ends of the first and second resonators formed on the third dielectric layer; and first and second ground planes formed respectively on the fourth and fifth dielectric layers, wherein each of the patterns of the first and second inductors is composed of a low impedance portion formed of wide-width lines and a high impedance portion formed of meander-type narrow-width lines from the low impedance portion.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
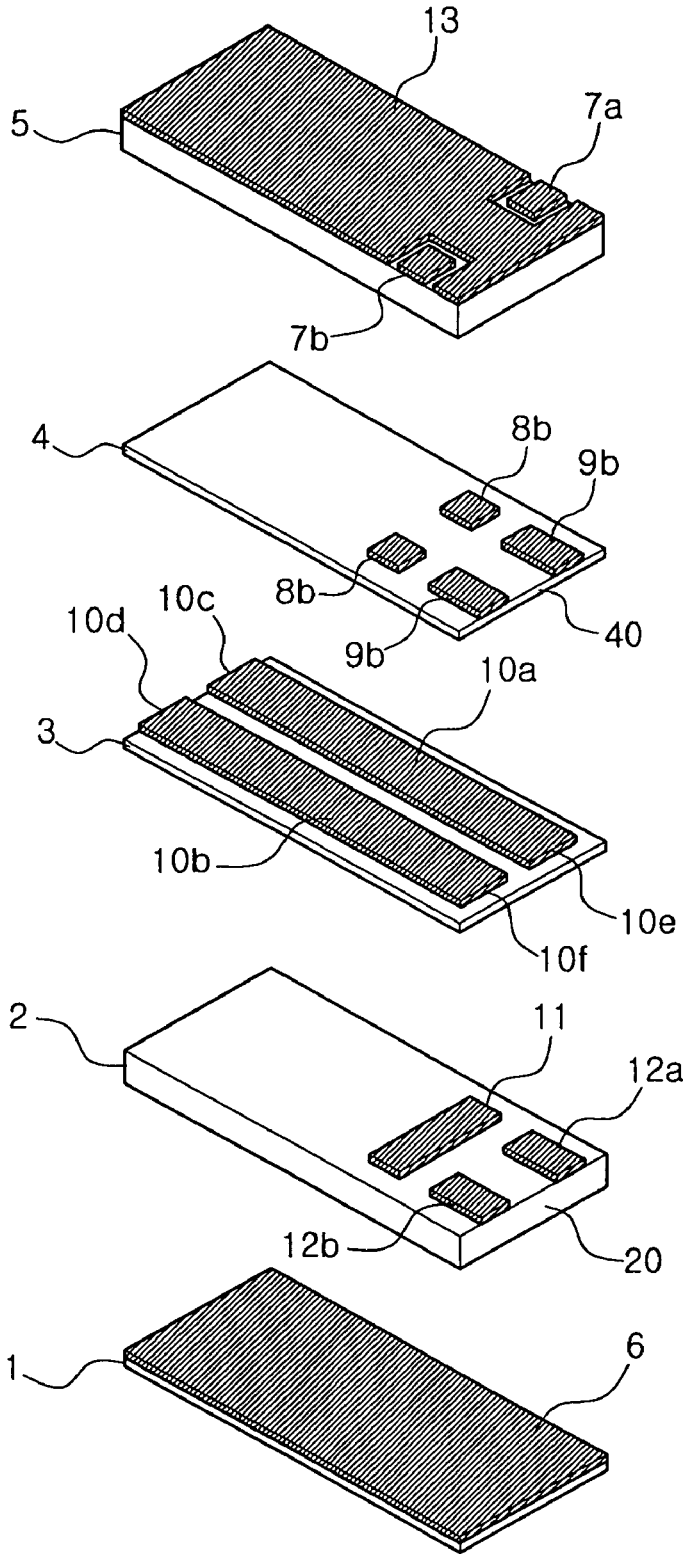
PRIOR ART FIG. 1
FIG. 1 is a diagram illustrating a configuration of a conventional multi-layered band pass filter.
Figure 2:
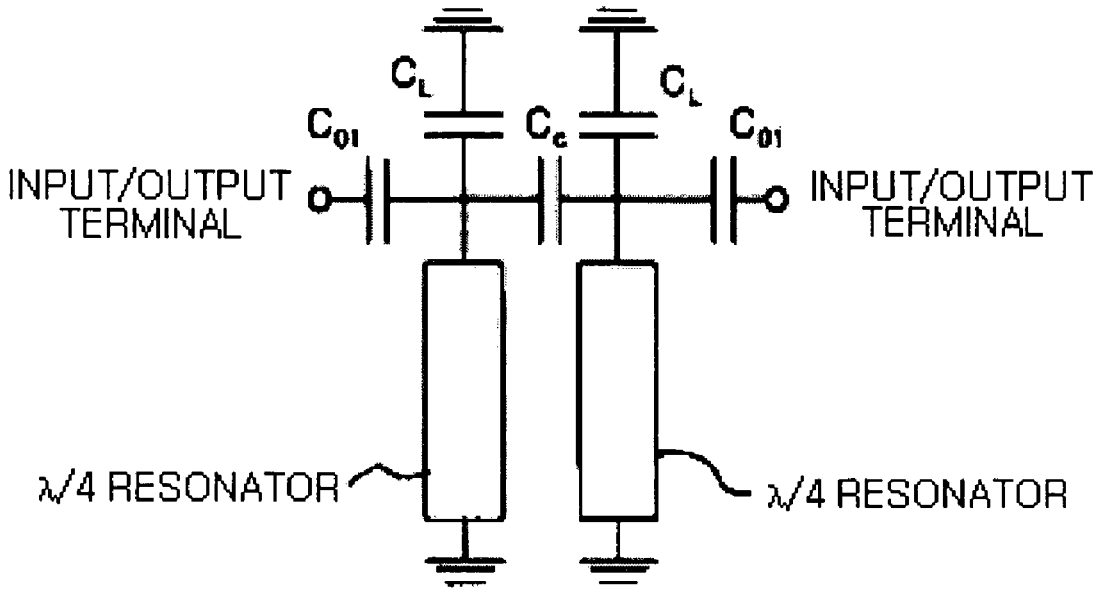
PRIOR ART FIG. 2
FIG. 2 is an equivalent circuit view of the multi-layered band pass filter as shown in FIG. 1.

Exemplary embodiments of the present invention will now be described in detail with reference to the accompanying drawings. However, the description proposed herein is just a preferable example for the purpose of illustrations only, not intended to limit the scope of the invention, so it should be understood that other equivalents and modifications could be made thereto without departing from the spirit and scope of the invention. Therefore, the shapes and sizes of parts shown in the accompanying drawings may be expressed exaggeratedly for clarity and the same parts have the same reference numerals in the accompanying drawings.

Figure 3:
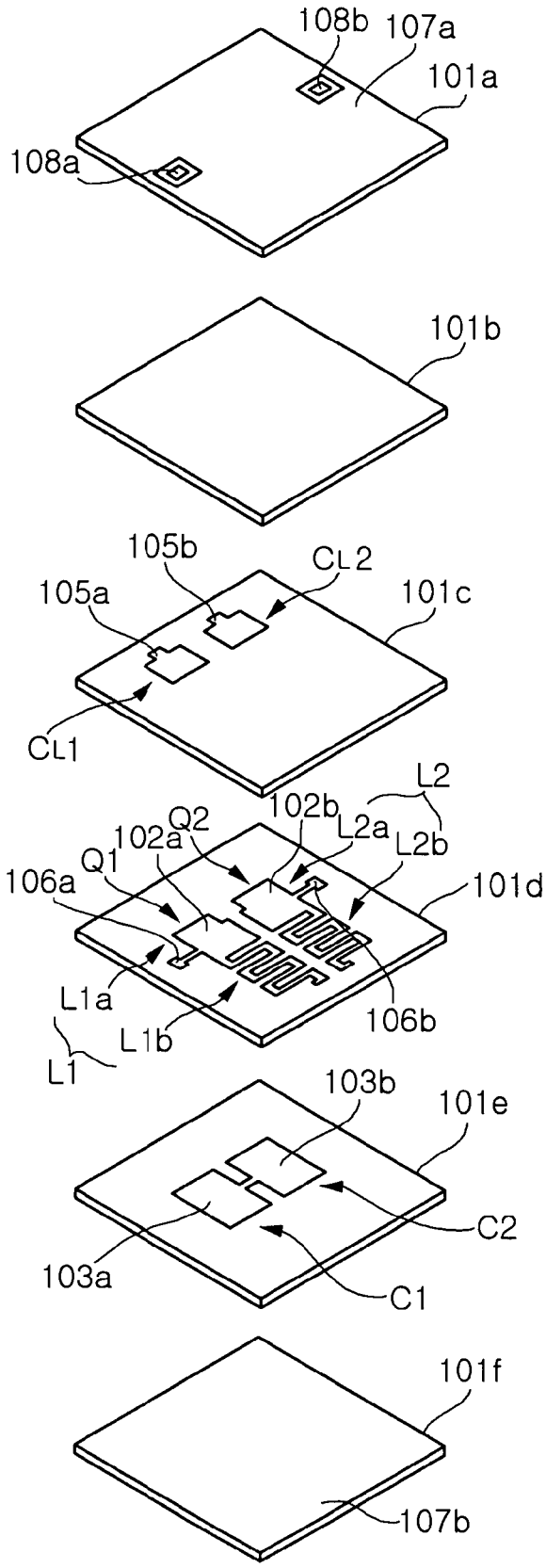
FIG. 3 is a diagram illustrating a configuration of a multi-layered band pass filter according to an exemplary embodiment of the present invention.
Figure 4:
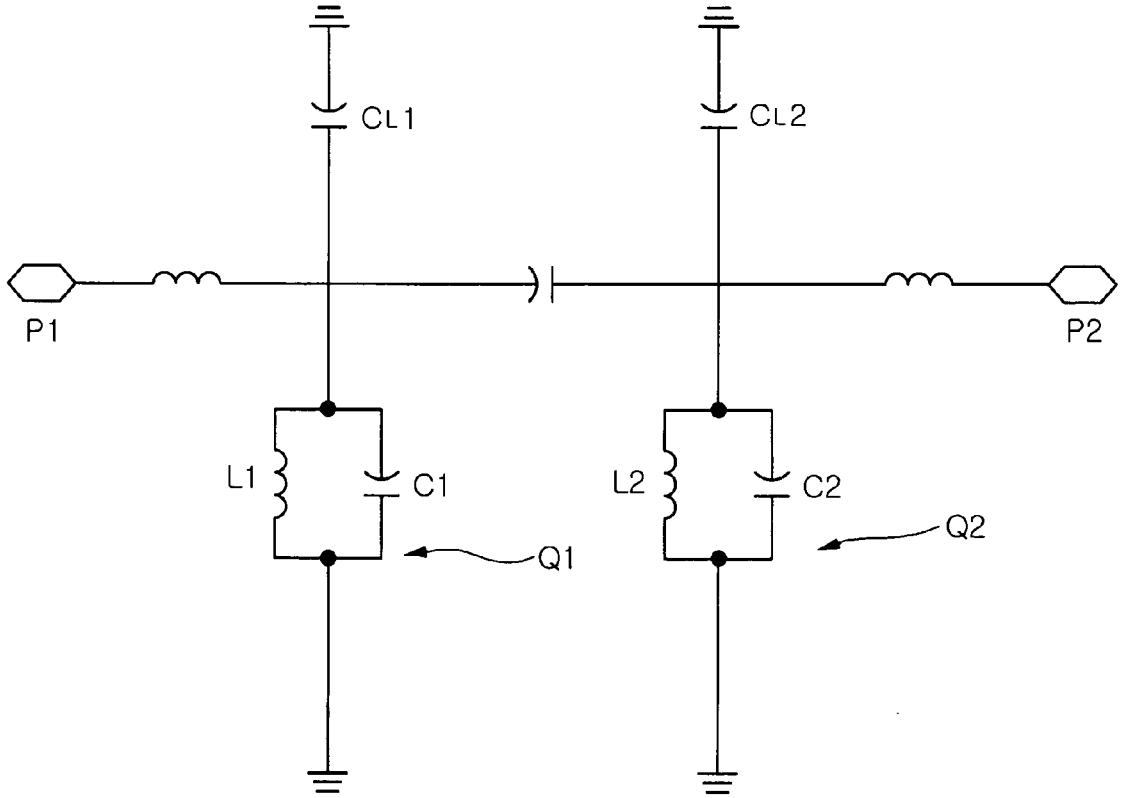
FIG. 4 is an equivalent circuit view of the multi-layered band pass filter as shown in FIG. 3.

FIG. 3 is a diagram illustrating a configuration of a multi-layered band pass filter according to an exemplary embodiment of the present invention, and FIG. 4 is an equivalent circuit view of the multi-layered band pass filter as shown in FIG. 3.

The multi-layered band pass filter according to an exemplary embodiment of the present invention is manufactured by laminating a plurality of dielectric layers 101*a*-101*f* made of ceramic dielectric materials and disposing first- and second-stage resonators Q1 and Q2 in an integrally fired ceramic laminated body so that the resonators Q1 and Q2 can be parallel to each other.

The first-stage resonator Q1 includes an inductor pattern 102*a* formed on the dielectric layer 101*d*, and a capacitor pattern 103*a* formed on the dielectric layer 101*e* so that it can be at least partially overlapped with the inductor pattern 102*a*.

The second-stage resonator Q2 includes an inductor pattern 102*b* formed on the dielectric layer 101*d*, and a capacitor pattern 103*b* formed on the dielectric layer 101*e* so that it can be at least partially overlapped with the inductor pattern 102*b*.

The inductor pattern 102*a* and the capacitor pattern 103*a* are disposed symmetrically with respective to, and in parallel to, the inductor pattern 102*b* and the capacitor pattern 103*b*, respectively.

Here, the capacitor pattern 103*a* and the capacitor pattern 103*b* are coupled to provide a capacitive capacitor.

A gap between resonators is adjusted to determine a pass bandwidth in the prior art, but a coupling level of the capacitor pattern 103*a* to the capacitor pattern 103*b* may be adjusted to determine a pass band width in this exemplary embodiment.

In particular, the inductor patterns 102*a* and 102*b* are composed of a low impedance portion formed of wide-width lines and a high impedance portion formed of meander-type narrow-width lines from the low impedance portion.

That is to say, an inductance L1 of the first-stage resonator Q1 is composed of a low impedance portion L1*a* formed of wide-width lines and a high impedance portion (L1*b*) formed of meander-type narrow-width lines from the low impedance portion L1*a*.

Also, an inductance L2 of the second-stage resonator Q2 is composed of a low impedance portion L2*a* formed of wide-width lines and a high impedance portion L2*b* formed of meander-type narrow-width lines from the low impedance portion L2*a*.

As described above, a stop characteristic in a band range other than the pass band may be improved by maintaining a constant ratio of the low impedance portion to the high impedance portion since the used step-impedance resonator is composed of the wide-width lines and the narrow-width lines. And, it is possible to reduce the entire size of the filter since the high impedance portion is formed in a meander type.

That is to say, the resonators according to an exemplary embodiment of the present invention are manufactured by coupling a narrow area to a wide area to become a constant length ratio, not by coupling the areas having the same width in a $\lambda/4$ length of the resonator corresponding to a frequency used to pass a signal. The filter according to an exemplary embodiment of the present invention has an excellent stop characteristic of the upper band around the center frequency, compared to the filters composed of resonators having a constant width, and therefore it is possible to significantly reduce a physical size of the filter since there is no additional component and the narrow area is formed in a meander type.

The above-mentioned first- and second-stage resonators Q1 and Q2 are electrically coupled to each other by load capacitors $C_L$1 and $C_L$2. That is to say, ends of the low impedance portions L1*a* and L2*a* of the resonators Q1 and Q2 are coupled to a grounding conductor 107*a* through the coupling to the load capacitors $C_L$1 and $C_L$2. The load capacitors $C_L$1 and $C_L$2 are formed by load capacitor patterns 105*a* and 105*b* formed on the dielectric layer 101*c*.

As described above, when the load capacitors $C_L$1 and $C_L$2 are coupled to the low impedance portions of the resonators Q1 and Q2, the stop characteristic of the upper band may be improved and a $\lambda/4$ length of the resonator may be reduced at the same time. That is to say, the increased number of the capacitors makes it possible to reduce an electrical length of the filter instead of reducing its physical length.

First and second ground planes 107*a* and 107*b* are printed respectively on the uppermost dielectric layer 101*a* and the lowermost dielectric layer 101*f* of the laminated body 100. Here, the first ground plane 107*a* is coupled to ends of the load capacitors $C_L$1 and $C_L$2 and the second ground plane 107*b* is coupled to ends of the high impedance portions L1*b* and L2*b*.

Tap-shaped input/output terminals 106*a* and 106*b* coupled to input/output electrodes 108*a* and 108*b* formed on the dielectric layer 101*a* are provided in ends of the first and second resonators Q1 and Q2, respectively. Here, the input/output electrodes 108*a* and 108*b* are formed by removing tetragonal regions from the first ground plane 107*a* to insulate them from the first ground plane 107*a*.

As described above, attenuation characteristics may be improved by adjusting a position of the tap in the resonators since the input/output units are not coupled to the resonator through the capacitor in the prior art, but directly coupled to the resonators with a tap shape. That is to say, a frequency which can hinder secondary characteristics of the upper band may be determined according to the position of the input/output units by forming the input/output units coupled directly to the resonators with a tap shape to determine, and it is also possible to improve the stop characteristic of the upper band.

A plurality of the dielectric layers may be manufactured with a low temperature co-fired ceramic (LTCC) substrate.

Also, at least one dielectric layer 101*b*, on which a pattern is not printed to maintain a constant thickness of the dielectric layer 101, may be further inserted between the dielectric layer 101*a* and the dielectric layer 101*c*. Although not shown herein, at least one dielectric layer, on which a pattern is not printed to maintain a constant thickness of the dielectric layer 101, may be further inserted between the dielectric layer 101*e* and the dielectric layer 101*f*.

For the filter according to an exemplary embodiment of the present invention, the resonators Q1 and Q2 are operated integrally as one λ/4 resonator.

Figure 5:
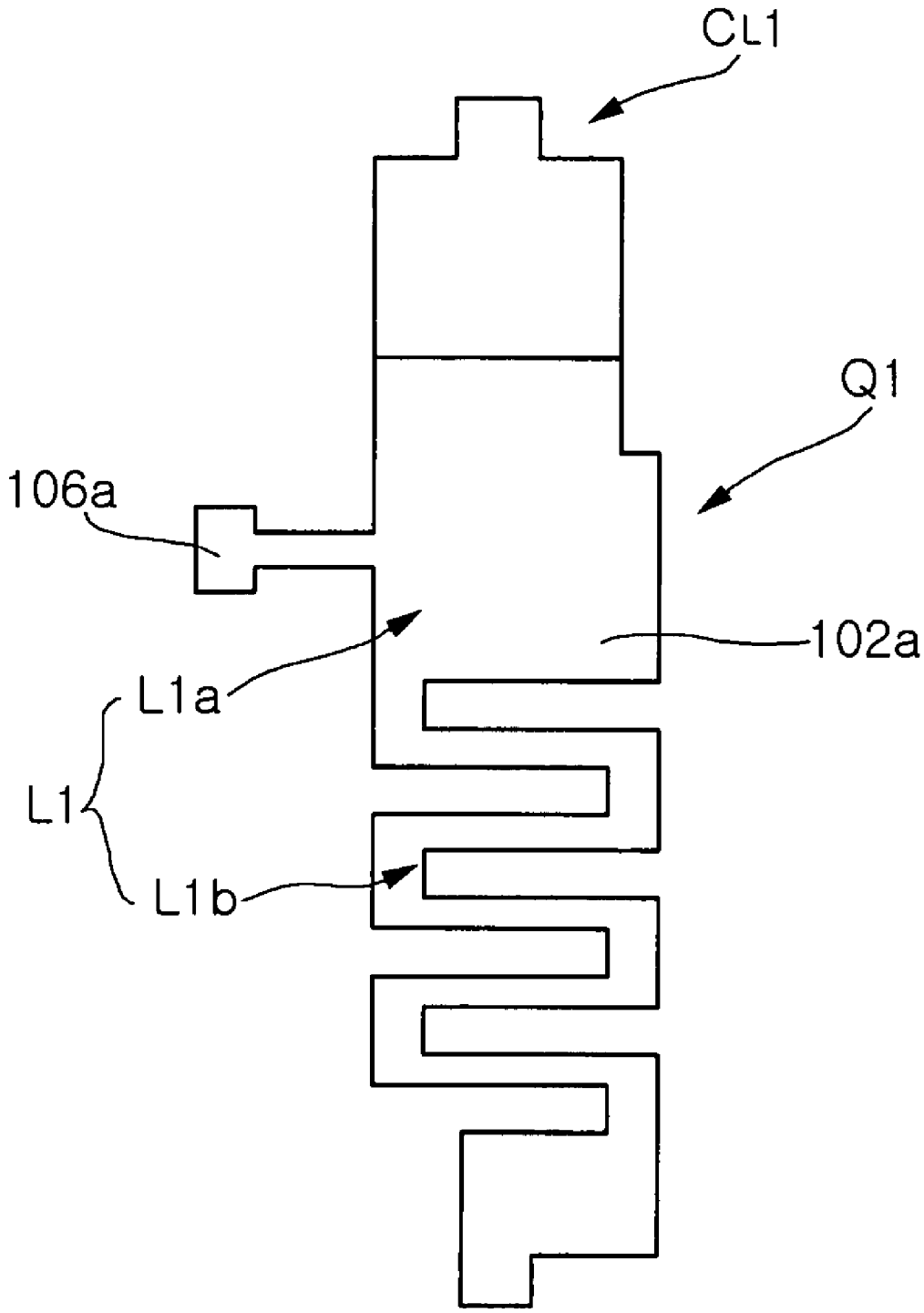
FIG. 5 is a diagram illustrating a load capacitor; and a resonator coupled to input/output terminals, all of which constitute the multi-layered band pass filter according to an exemplary embodiment of the present invention.
Figure 6:
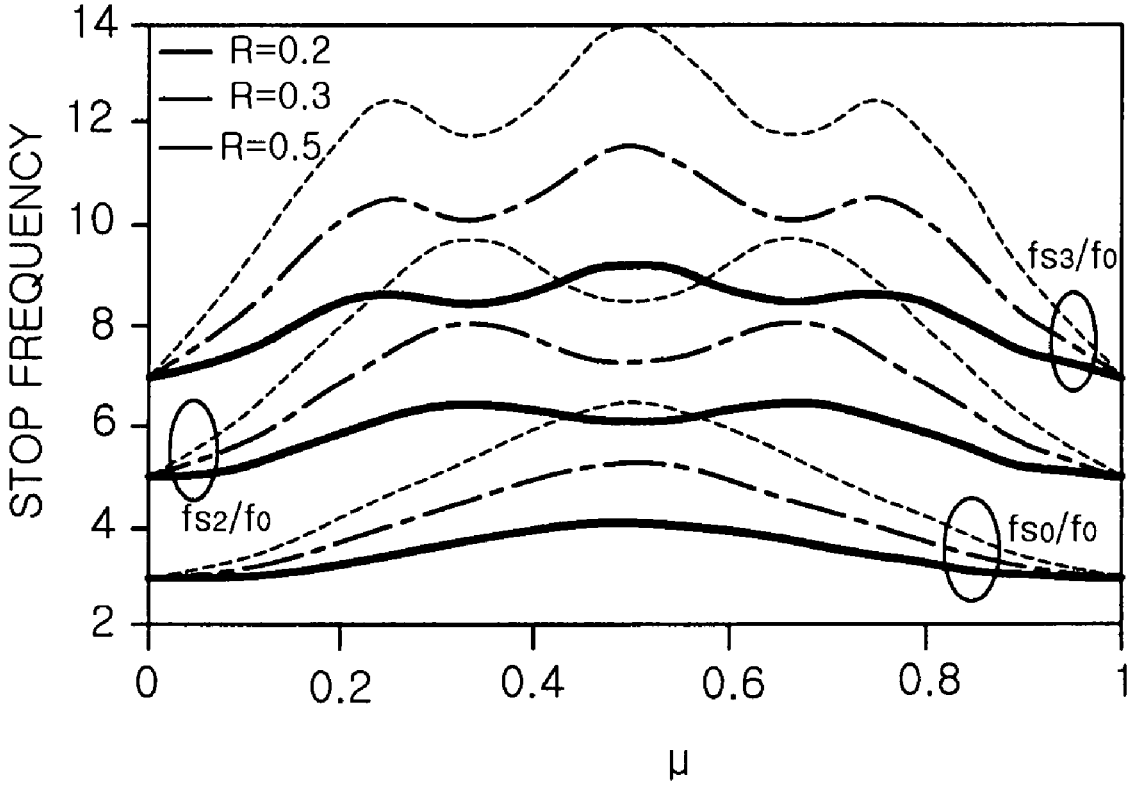
FIG. 6 is a graph illustrating impedance ratios (R) of the resonator as shown in FIG. 5, and stop frequency characteristics according to the relative length (u) of a high impedance portion and a low impedance portion.

FIG. 5 illustrates a load capacitor $C_L$1; and a resonator Q1 coupled to input/output terminals, all of which constitute the multi-layered band pass filter according to an exemplary embodiment of the present invention, and FIG. 6 illustrates impedance ratios (R) of the resonator as shown in FIG. 5, and stop frequency characteristics according to the relative length (u) of a high impedance portion and a low impedance portion.

Referring to FIG. 6, it might be seen that the stop frequency characteristic is improved when the impedance ratio (R) and the relative length (u) is adjusted to a suitable extent.

Figure 7:
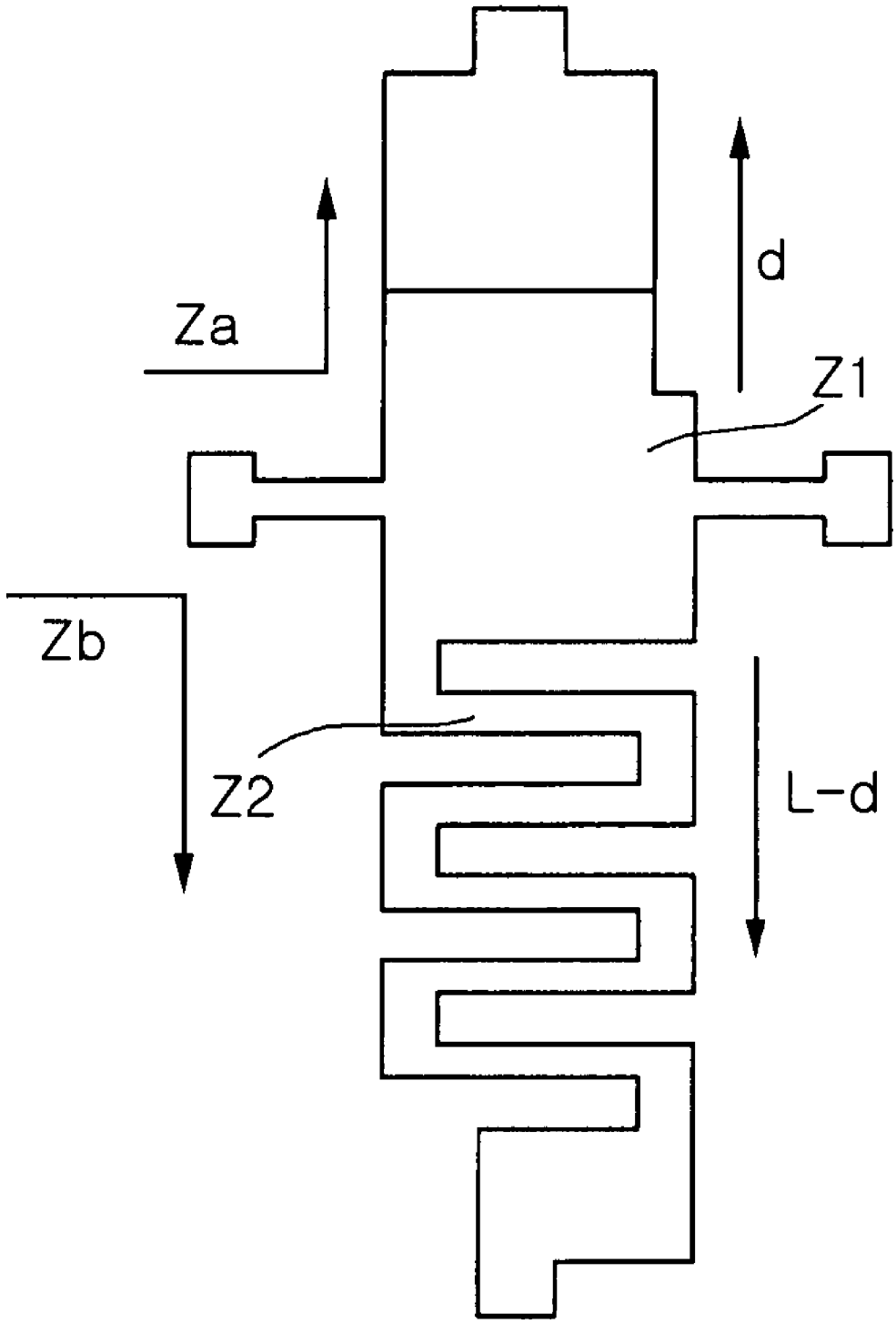
FIG. 7 is a diagram analyzing the effects of positions of tap-shaped input/output terminals when the tap-shaped input/output terminals are coupled to a resonator according to an exemplary embodiment of the present invention.

FIG. 7 is a diagram analyzing the effects of positions of tap-shaped input/output terminals when the tap-shaped input/output terminals are coupled to a resonator according to an exemplary embodiment of the present invention.

As shown in FIG. 7, Za and Zb represent input impedances when each of the load capacitors is seen from a position of the tap, and the position of the tap is determined as a distance (d) that is remote from a tip of the low impedance portion in the entire length (L). The position of the tap is varied by changing the distance (d), and therefore the stop characteristic of the upper band is determined.

$$Z_a = \frac{jZ_1\left\{Z_1\omega C_L \tan\left(\frac{wd}{v}\right) - 1\right\}}{\tan\left(\frac{wd}{v}\right) - Z_1\omega C_L} \quad \text{Equation (1)}$$

$$Z_b - jZ_2\tan\left\{\frac{w(L-d)}{v}\right\} \quad \text{Equation (2)}$$

Equations 1 and 2 are used to calculate input impedances Za and Zb, respectively. Here, "v" is a wave velocity, and "w" is a frequency. The stop characteristic appears within the upper band when the input impedance Za or Zb is 0, and a stop frequency (fp) of the upper band is determined by the following Equations 3 and 4. Here, "N" represents integers such as 0, 1, 2, or more.

$$\tan\left(\frac{2\pi f_p d}{v}\right) = \frac{1}{2\pi f_p Z_1 C_L} \quad \text{Equation (3)}$$

$$f_p = \frac{vN}{2(L-d)} \quad \text{Equation (4)}$$

Figure 8:
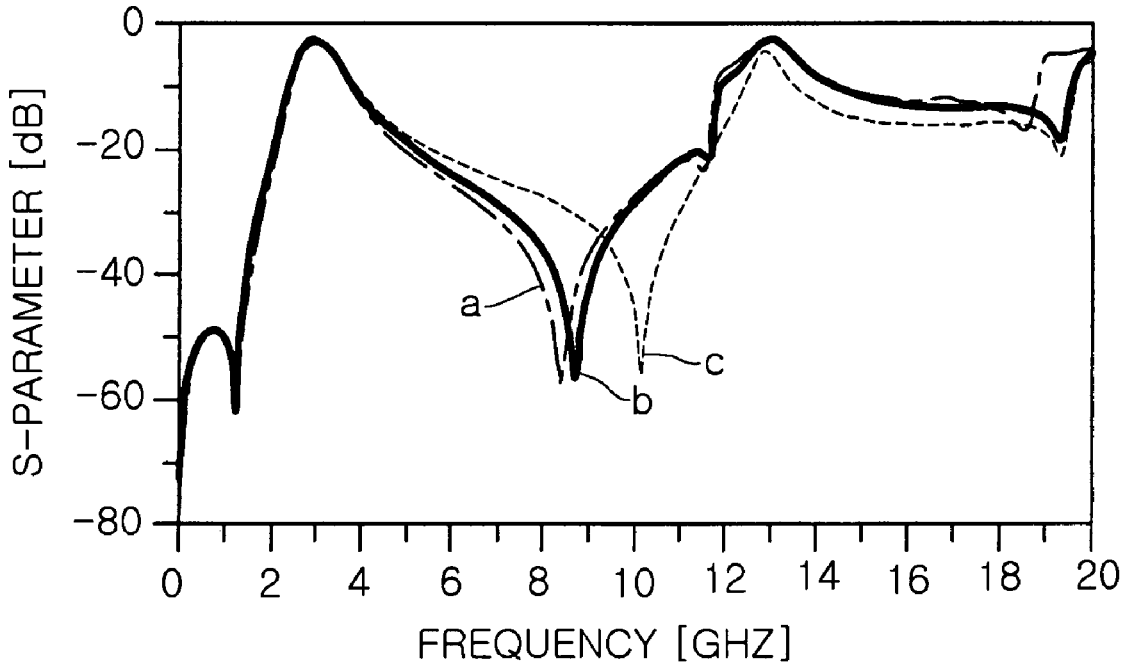
FIG. 8 is a graph illustrating a stop characteristic to a stop frequency of an upper band according to the changes of input/output coupling terminals according to an exemplary embodiment of the present invention.

FIG. 8 illustrates a stop characteristic to a stop frequency (fp) of an upper band according to the changes of input/output coupling terminals according to an exemplary embodiment of the present invention, and particularly illustrates attenuation characteristics of stop bands appearing whenever a distance (d) value is gradually increased. As shown in FIG. 7, "a" is a graph represented when the distance (d) has the highest value, and "c" is a graph represented when the distance (d) has the lowest value.

Referring to FIG. 8, it might be seen that the characteristics of the stop band are varied, but the attenuation loss in the pass band is not affected.

The load capacitor, as used herein, is coupled to a low impedance portion of a cascade resonator to function to reduce a physical length of the resonator and improve the stop characteristic of the upper band.

The following Equation 5 is used to calculate a $C_L$ value used to hinder characteristics for a certain frequency of the upper band.

$$C_L = \frac{Y_0 \cot\theta_r}{\omega_0} \quad \text{Equation (5)}$$

Correlation between the physical length value of the resonator corresponding to θr and the $C_L$ value can be seen from the Equation 5.

However, a lot of signals are lost since the higher the $C_L$ value is, the lower the impedance of the load capacitor is. As a result, the insertion loss of the inputted signals is increased, which leads to the deteriorated wireless communication system.

Accordingly, the optimum value between the insertion loss and the $C_L$ value, which determines the stop characteristic of the upper band and the physical length of the resonators, was determined experimentally, and the insufficient stop characteristic functions to improve the stop characteristic of the certain frequency by adjusting a position of the above-mentioned input/output terminals.

Figure 9:
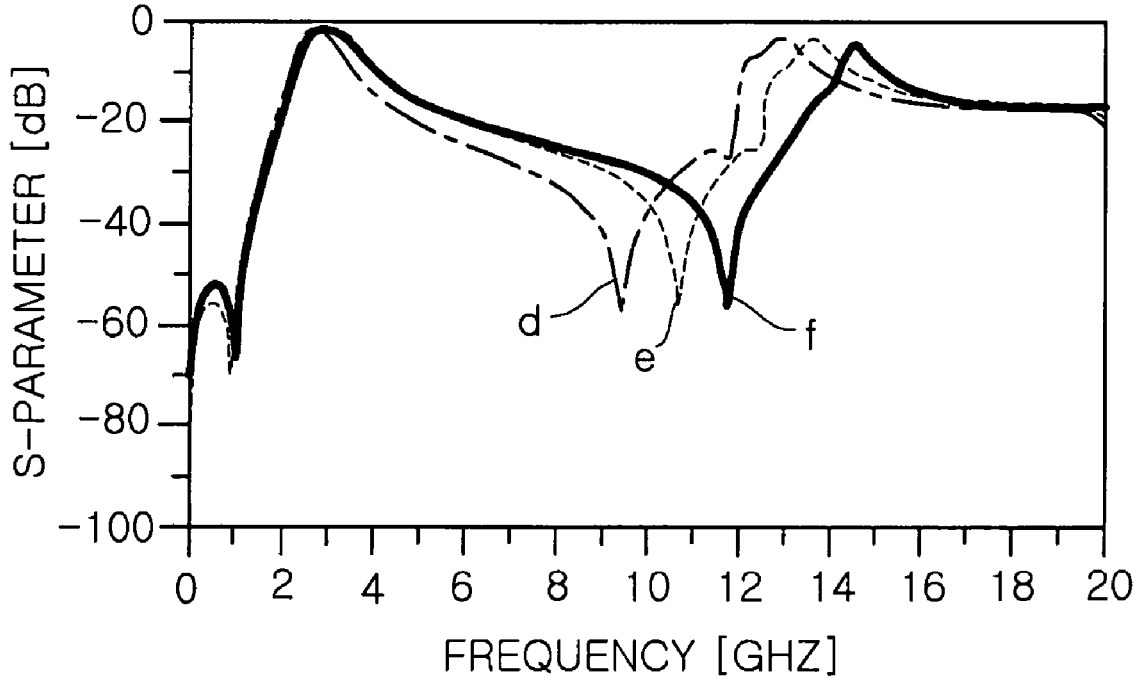
FIG. 9 is a graph illustrating a stop characteristic and a stop frequency in an upper band according to the increasing capacitance value of the load capacitor according to an exemplary embodiment of the present invention.

FIG. 9 illustrates a stop characteristic and a stop frequency in an upper band according to the increasing capacitance value of the load capacitor according to an exemplary embodiment of the present invention.

As shown in FIG. 9, it is revealed that "d" is a graph represented when the distance (d) has the highest capacitance value and the stop frequency represents the most approximate value to the center frequency, but values of the insertion loss and return loss are undesirably increased. Therefore, an effect on the capacitance value of the load capacitor should be compensated for by the position of the tap-shaped input/output terminals, as proposed herein.

Figure 10:
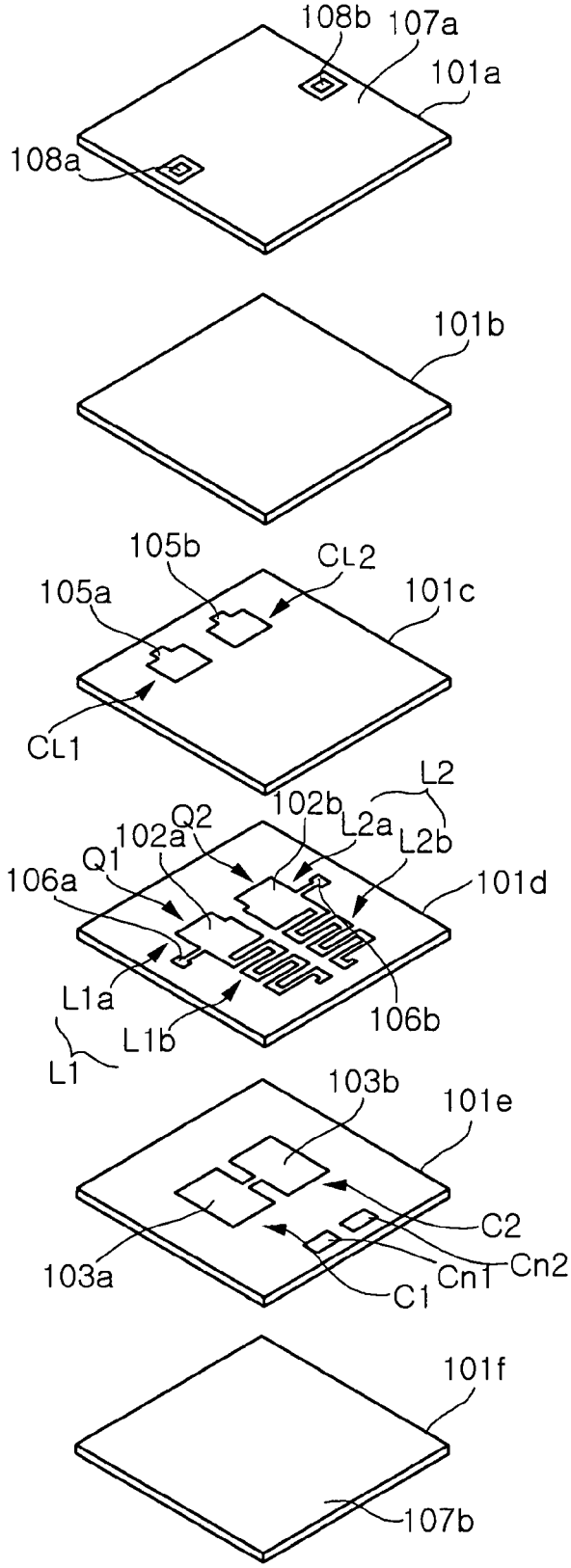
FIG. 10 is a diagram illustrating a configuration of a multi-layered band pass filter according to another exemplary embodiment of the present invention.
Figure 11:
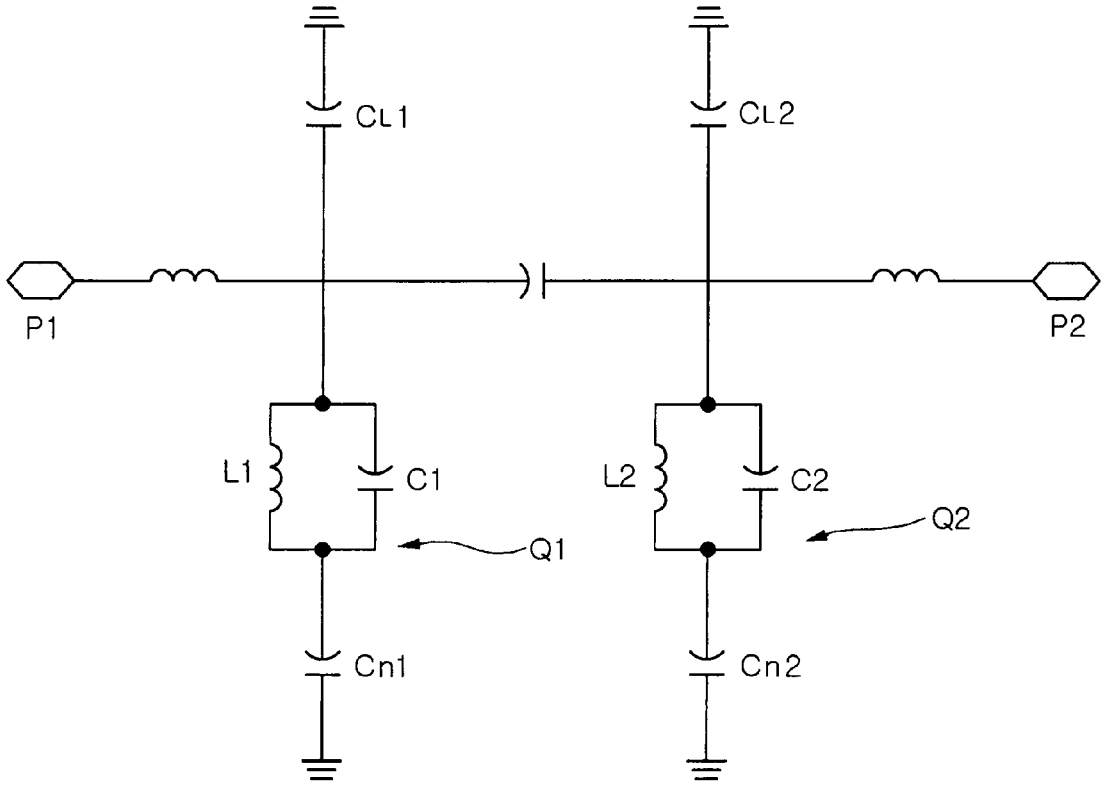
FIG. 11 is an equivalent circuit view of the multi-layered band pass filter as shown in FIG. 10.

Meanwhile, FIG. 10 is a diagram illustrating a configuration of a multi-layered band pass filter according to another exemplary embodiment of the present invention, and FIG. 11 is an equivalent circuit view of the multi-layered band pass filter as shown in FIG. 10.

It may be understood that the multi-layered band pass filter according to an exemplary embodiment has a configuration in which notching capacitors Cn1 and Cn2 are further included in the multi-layered band pass filter as shown in FIG. 3, and the same parts have the same reference numerals in the accompanying drawings. Therefore, only the notching capacitors Cn1 and Cn2 will be described in detail.

For this exemplary embodiment, the notching capacitors Cn1 and Cn2 are electrically capacitively coupled to the other ends of the resonators Q1 and Q2, respectively. In this case, the notching capacitors Cn1 and Cn2 are formed with notching capacitor pattern formed on the dielectric layer 110*e*.

The notching capacitors Cn1 and Cn2 may be coupled respectively to high impedance portions L1*b* and L2*b* of the resonators Q1 and Q2 and grounded to the second ground plane 107*b*.

As described above, the notching capacitors coupled to the high impedance portions L1*b* and L2*b* of the resonators Q1 and Q2 are formed to enhance a stop characteristic of the upper band of the filter.

That is to say, in a configuration where a capacitor is coupled to a high impedance portion and a tip of the high impedance portion is coupled to a grounding conductor, resonance may be caused in a frequency (Ws) in which the relation between the resonator and the capacitor satisfies the following Equation 6, thereby improving the stop characteristic.

As described above, the multi-layered band pass filter according to this exemplary embodiment provides a notching capacitor coupled to a high impedance portion of a resonator in order to enhance a stop characteristic of a lower band. In a configuration where a capacitor is coupled to a high impedance portion and a tip of the high impedance portion is coupled to a grounding conductor, resonance may be caused in a frequency (Ws) in which the relation between the resonator and the capacitor satisfies the following Equation 6, thereby improving the stop characteristic of the filter.

$$\omega_s = \frac{1}{\sqrt{L_0(C_s + C_0)}} \qquad \text{Equation (6)}$$

Figure 12:
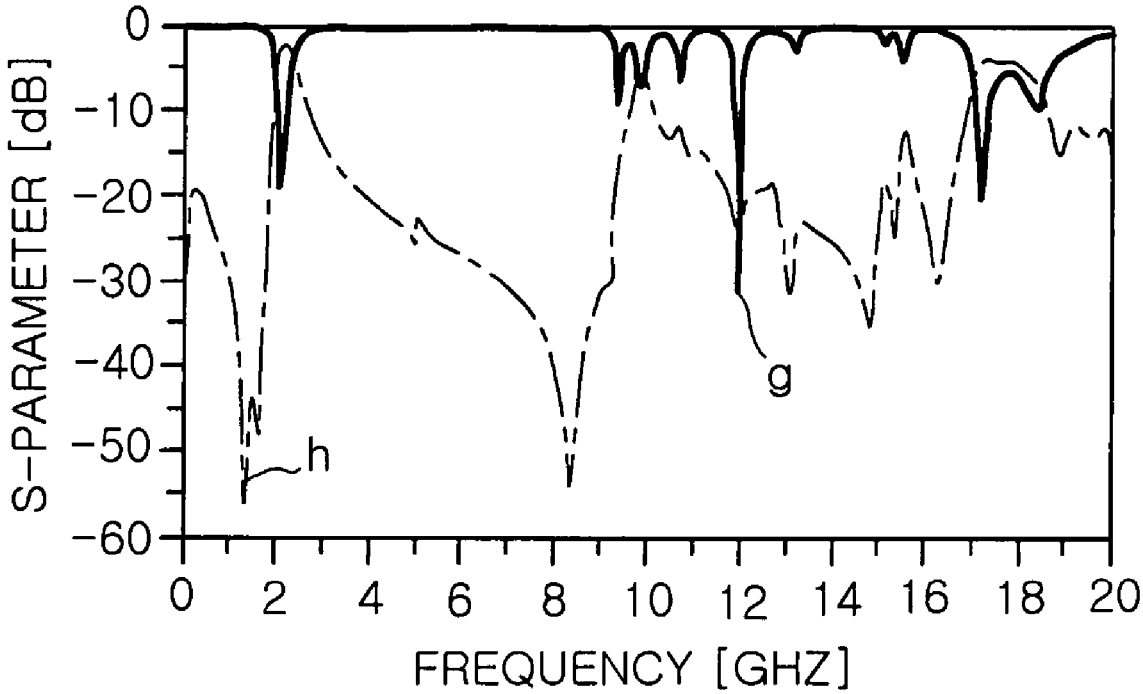
FIG. 12 is a graph illustrating a stop characteristic of the band pass filter according to another exemplary embodiment of the present invention as shown in FIG. 10.

FIG. 12 is a graph illustrating a stop characteristic of the band pass filter according to another exemplary embodiment of the present invention.

Referring to FIG. 12, "g" represents a stop characteristic of an upper band formed with the position of the tap-shaped input/output terminals and the suitable capacitance value of a load capacitor, and "h" represents a stop characteristic of a lower band formed with a capacitance value of a notching capacitor.

As described previously above, the multi-layered band pass filter according to an exemplary embodiment of the present invention can be useful to improve a harmonic attenuation characteristic according to the relative lengths of the impedance portions, and therefore improve a stop characteristic out of a pass band, by maintaining a constant ratio of a high impedance portion and a low impedance portion, that is, a constant impedance ratio of the high impedance portion and the low impedance portion, using a step-impedance resonator, and to reduce the entire size of the filter by forming the high impedance portion coupled to a grounding conductor in a meandered form.

Also, the multi-layered band pass filter according to an exemplary embodiment of the present invention can be useful to improve an attenuation characteristic by directly coupling input/output units to the resonator with a tap shape to adjust a position of a tap in a resonator, and to improve a stop characteristic of the lower band formed with a capacitance value of the notching capacitor.

Also, the multi-layered band pass filter according to an exemplary embodiment of the present invention may be installed inside a system module to be manufactured, and an active device, a passive device and the like are mounted on the system module, and the multi-layered band pass filter can be useful to reduce the size of the entire system.

While the present invention has been shown and described in connection with the exemplary embodiments, it will be apparent to those skilled in the art that modifications and variations can be made without departing from the spirit and scope of the invention as defined by the appended claims.

What is claimed is:

1. A band pass filter comprising:

a ceramic laminated body having at least first to fifth dielectric layers laminated sequentially therein;

first and second resonators having symmetrical patterns of first and second inductors formed on the third dielectric layer, and symmetrical patterns of first and second capacitors formed on the second dielectric layer so that they are at least partially overlapped with the patterns of the first and second inductors;

patterns of first and second load capacitors electrically capacitively coupled respectively to the first and second resonators formed on the fourth dielectric layer; and first and second ground planes formed respectively on the first and fifth dielectric layers, wherein each of the patterns of the first and second inductors is composed of a low impedance portion formed of wide-width lines and a high impedance portion grounded to the second ground plane and formed of meandering narrow-width lines from the low impedance portion, and tap-shaped input/output terminals directly coupled to input/output electrodes formed on the first dielectric layer are provided in ends of the first and second resonators, respectively.

2. The band pass filter of claim 1, wherein the ceramic laminated body is a low temperature co-fired ceramic (LTCC) substrate.

3. The band pass filter of claim 1, wherein at least one thickness-controlling dielectric layer is further inserted into at least one space between the first dielectric layer and the second dielectric layer, and between the fourth dielectric layer and the fifth dielectric layer.

4. A band pass filter comprising:

a ceramic laminated body having at least first to fifth dielectric layers laminated sequentially therein;

first and second resonators having symmetrical patterns of first and second inductors formed on the third dielectric layer, and symmetrical patterns of first and second capacitors formed on the second dielectric layer so that they are at least partially overlapped with the patterns of the first and second inductors;

patterns of first and second load capacitors electrically capacitively coupled respectively to ends of the first and second resonators formed on the fourth dielectric layer;

patterns of first and second notching capacitors electrically capacitively coupled respectively to the other ends of the first and second resonators formed on the fourth dielectric layer; and first and second ground planes formed respectively on the first and fifth dielectric layers, wherein each of the patterns of the first and second inductors is composed of a low impedance portion formed of wide-width lines and a high impedance portion formed of meandering narrow-width lines from the low impedance portion, and tap-shaped input/output terminals directly coupled to input/output electrodes formed on the first dielectric layer are provided in ends of the first and second resonators, respectively.

5. The band pass filter of claim 4, wherein the first and second notching capacitors are coupled respectively to the high impedance portion of the first and second resonator, and grounded to the second ground plane.

6. The band pass filter of claim 4, wherein the ceramic laminated body is a low temperature co-fired ceramic substrate.

7. The pass filter of claim 4, wherein at least one thickness-controlling dielectric layer is further inserted into at least one space between the first dielectric layer and the second dielectric layer, and between the fourth dielectric layer and the fifth dielectric layer.

* * * * *